US009923318B2

(12) United States Patent
Fujita et al.

(10) Patent No.: US 9,923,318 B2
(45) Date of Patent: Mar. 20, 2018

(54) ELECTRONIC DEVICE, AND GROUND STRUCTURE OF CABLE CONNECTOR CONNECTED TO ELECTRONIC DEVICE

(71) Applicant: Konica Minolta, Inc., Chiyoda-ku, Tokyo (JP)

(72) Inventors: Naoki Fujita, Toyokawa (JP); Masaki Takahashi, Toyokawa (JP); Hironao Miyamoto, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/642,661

(22) Filed: Jul. 6, 2017

(65) Prior Publication Data

US 2018/0026411 A1 Jan. 25, 2018

(30) Foreign Application Priority Data

Jul. 25, 2016 (JP) ..... 2016-145680

(51) Int. Cl.
*H01R 13/627* (2006.01)
*H01R 24/78* (2011.01)
*H01R 13/58* (2006.01)

(52) U.S. Cl.
CPC ..... *H01R 24/78* (2013.01); *H01R 13/5812* (2013.01)

(58) Field of Classification Search
CPC ..... H01R 13/6275; H01R 13/6272; H01R 33/22; H01R 13/635
USPC ..... 439/357, 953, 352, 253, 258
See application file for complete search history.

(56) References Cited

U.S. PATENT DOCUMENTS 4,302,066 A * 11/1981 Newman ..... H01R 13/6395 439/347
5,957,726 A * 9/1999 Belopolsky ..... H01R 13/65802 439/607.01
6,808,398 B2 * 10/2004 Fan ..... H01R 12/716 439/79
2017/0077649 A1 * 3/2017 Utz ..... H01R 13/5812

FOREIGN PATENT DOCUMENTS

JP 06-005333 A 1/1994
JP 09-097636 A 4/1997

* cited by examiner

*Primary Examiner* — Phuong Chi T Nguyen
(74) *Attorney, Agent, or Firm* — Squire Patton Boggs (US)

(57) ABSTRACT

An electronic device includes: a grounded shield plate; and a female-type interface connector, wherein a conductive member electrically connected to the shield plate is included, and when a male-type cable connector including a metal shell part and a holding part to hold the metal shell part is inserted into and connected to the interface connector, the conductive member is biased in such a manner as to come into contact with an exposed part that is on a side surface of the metal shell part and is between the holding part and the shield plate.

8 Claims, 6 Drawing Sheets

ELECTRONIC DEVICE, AND GROUND STRUCTURE OF CABLE CONNECTOR CONNECTED TO ELECTRONIC DEVICE

Japanese Patent Application No. 2016-145680 filed on Jul. 25, 2016, including description, claims, drawings, and abstract the entire disclosure is incorporated herein by reference in its entirety.

BACKGROUND

Technological Field

The present invention relates to an electronic device, more specifically, relates to a ground structure of a cable connector connected to an interface connector of an electronic device.

Description of the Related Art

Various electromagnetic noise countermeasures are applied to an electronic device, which includes an electronic circuit board, such as a computer in order to prevent intrusion of harmful electromagnetic noise from a device provided in a periphery.

As the most effective electromagnetic noise countermeasure, a method of surrounding an electronic circuit board with a shield plate including a grounded conductive plate is common.

Patent Literature 1: JP 9-97636 A

Patent Literature 2: JP 6-5333 A

However, in most cases, an electronic device is provided with a female-type interface connector for connection with an external device. When a cable connector for connection with an external device is connected to this interface connector, the cable functions, in a manner, as an antenna for picking up external electromagnetic noise and the external electromagnetic noise may intrude in the electronic device.

Normally, a metal shell on a side of the interface connector (hereinafter, referred to as "inner shell") is grounded, and a problem is not generated when a metal shell of the cable connector inserted into the interface connector is sufficiently in contact with the inner shell. However, in a viewpoint of easiness in insertion/extraction operation, or due to a reason such as a variation in a dimension of each component, there is a case where contact between the metal shell of the cable connector and the inner shell of the interface connector is not always good in a state where contacts or pins on the side of the interface connector and the side of the cable connector are connected.

In such a case, the metal shell on the side of the cable connector is not sufficiently grounded and electromagnetic noise, radiation noise, and the like may adversely influence the electronic circuit inside the electronic device.

SUMMARY

An object of the present invention is to provide, with a simple configuration, an electronic device in which a metal shell of a cable connector can be securely grounded via a shield plate, and a ground structure of the cable connector in the electronic device.

To achieve the abovementioned object, according to an aspect of the present invention, an electronic device reflecting one aspect of the present invention comprises: a grounded shield plate; and a female-type interface connector, wherein a conductive member electrically connected to the shield plate is included, and when a male-type cable connector including a metal shell part and a holding part to hold the metal shell part is inserted into and connected to the interface connector, the conductive member is biased in such a manner as to come into contact with an exposed part that is on a side surface of the metal shell part and is between the holding part and the shield plate.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of an electronic device according to the present invention will be described with reference to the drawings. However, the scope of the invention is not limited to the disclosed embodiments.

Figure 1:
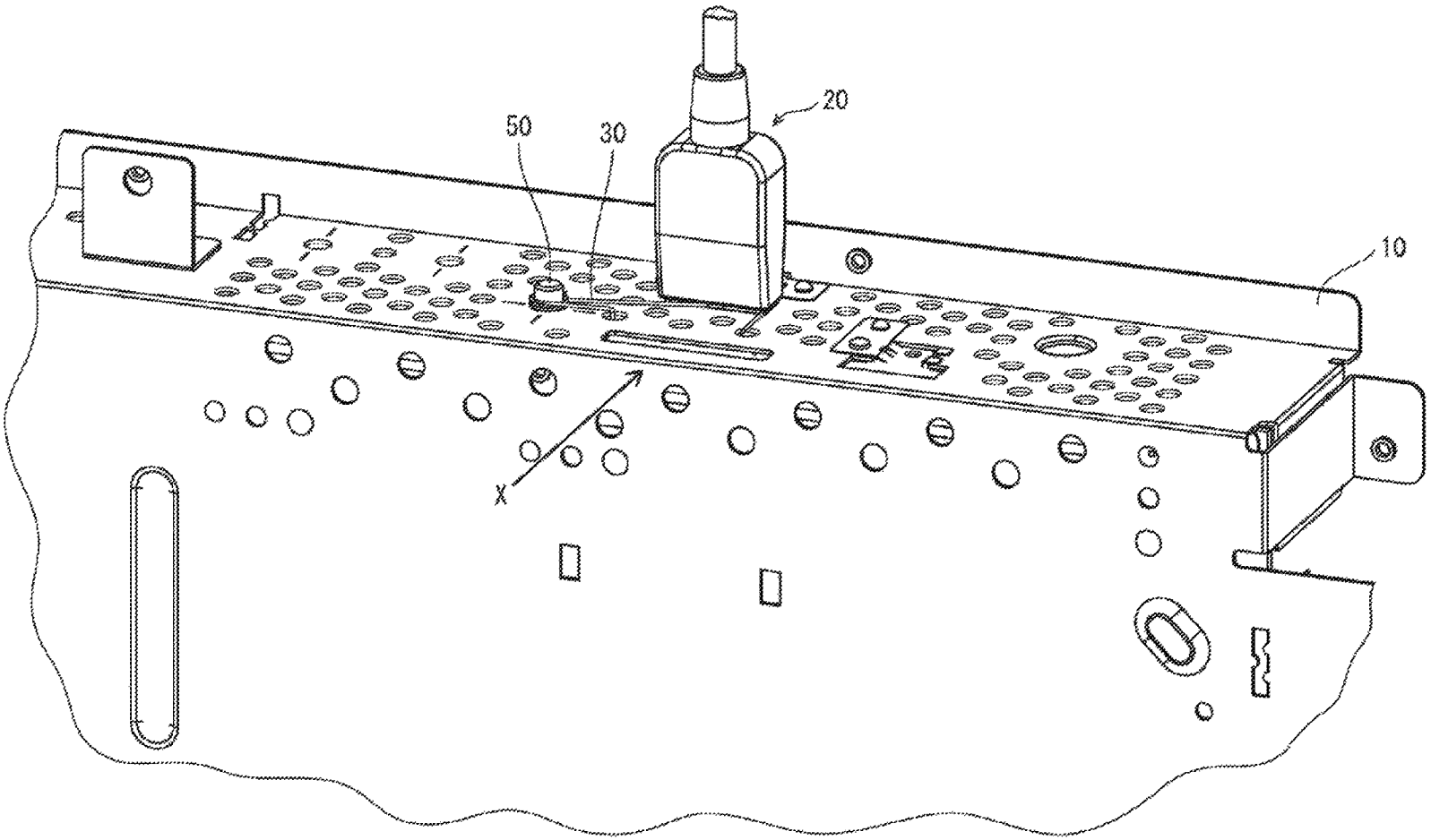
FIG. 1 is a perspective view of when a cable connector is connected to an electronic device.

FIG. 1 is a perspective view of when an outer covering of the electronic device according to the present embodiment is removed. In the drawing, a cable connector 20 is illustrated in a connected state.

An electronic circuit board (not illustrated) is arranged inside a chassis-shaped shield plate 10.

Since the shield plate 10 is made of a conductive metal plate and is grounded, the electronic circuit board therein is shielded from external electromagnetic noise.

Figure 2:
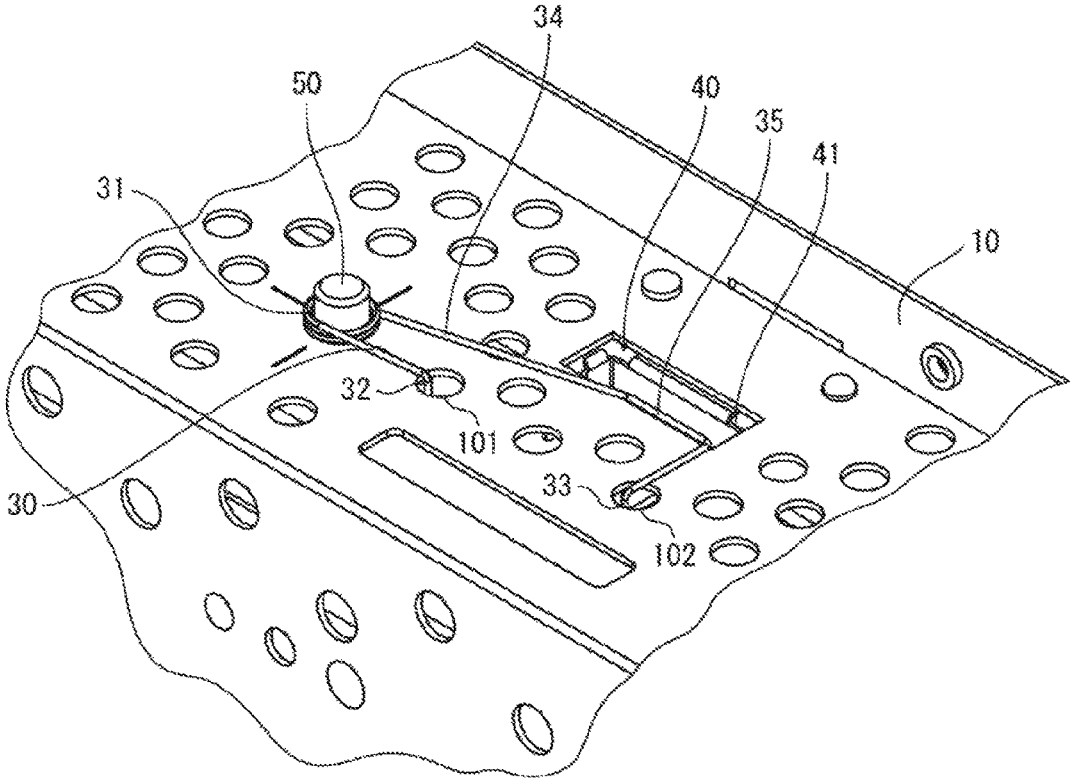
FIG. 2 is a perspective view illustrating a state of an opening part of an interface connector and a torsion coil spring of when the cable connector is removed in FIG. 1.

FIG. 2 is a view illustrating an opening part of an interface connector 40 and a periphery thereof of when the cable connector 20 is removed.

As illustrated in the drawing, the interface connector 40 is provided at an opening part of the shield plate 10, and a torsion coil spring 30 made of an elastic metal wire (wire spring) is arranged in the vicinity thereof.

A coil part 31 of the torsion coil spring 30 is pivotally supported by a metallic support pin 50. Locking parts 32 and 33 formed at both end parts of the torsion coil spring 30 are respectively engaged with through holes 101 and 102 of the shield plate 10. An inclined part 34 and a straight part 35 of the torsion coil spring 30 are held in a state of being biased toward the opening part of the interface connector 40.

The torsion coil spring 30 is in contact with and is electrically connected to the shield plate 10 via the locking parts 32 and 33 and the support pin 50 in the coil part 31. Accordingly, the torsion coil spring 30 is grounded via the shield plate 10.

Figure 3A:
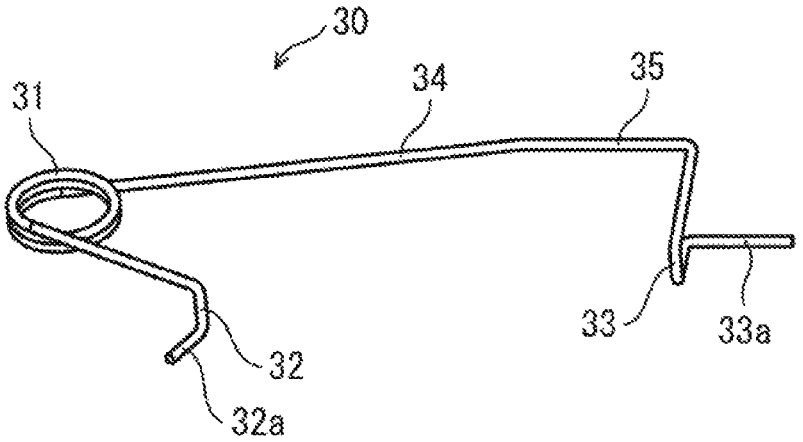
FIG. 3A is a perspective view of the torsion coil spring.

FIG. 3A is a perspective view illustrating a whole shape of the torsion coil spring 30.

As illustrated in the drawing, a leading end part of the locking part 32 of the torsion coil spring 30 forms a first bent part 32*a* bent in an L shape. An L-shaped bent end of a leading end part of the locking part 33 includes a second bent part 33*a* bent further outward. Shapes hard to come off the through holes 101 and 102 of the shield plate 10 are respectively included.

Figure 3B:
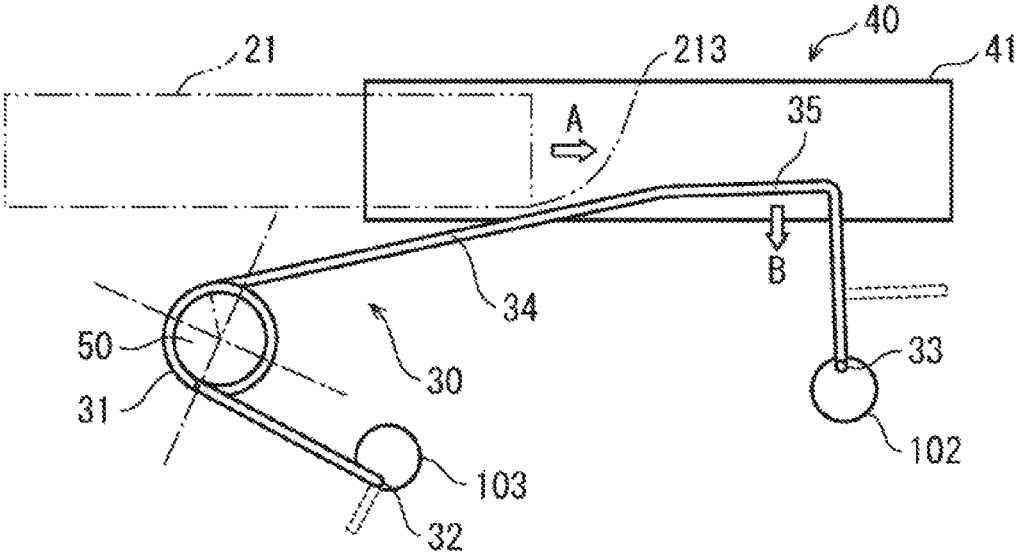
FIG. 3B is a view illustrating a positional relationship between an opening part of an inner shell of the interface connector and the torsion coil spring of when the torsion coil spring is attached to a shield plate.

FIG. 3B is a plan view in the vicinity of the interface connector 40 of when FIG. 2 is viewed from directly above (that is, when viewed in planar manner in insertion direction of interface connector 40).

As illustrated in the drawing, in a state where the cable connector 20 is not attached to the interface connector 40, the torsion coil spring 30 is protruded for a predetermined amount by elastic force thereof in such a manner that a part of the inclined part 34 and the straight part 35 are overlapped with an opening part of an inner shell 41 of the interface connector 40.

By being engaged with the through hole 102, the locking part 33 of the torsion coil spring 30 is controlled in such a manner as not to be protruded toward the interface connector 40 for more than necessary.

When the cable connector 20 is inserted into the interface connector 40, a corner part 213 of an end part of a metal shell 21 of the cable connector 20 is first abutted to the inclined part 34 of the torsion coil spring 30 and is moved to a right side in the drawing (direction of arrow A) to move the inclined part 34 and the straight part 35 in a direction B against biasing force of the coil part 31. Subsequently, the metal shell 21 of the cable connector 20 is inserted into the inner shell 41 of the interface connector 40. In such a manner, insertion is performed easily.

Figure 4:
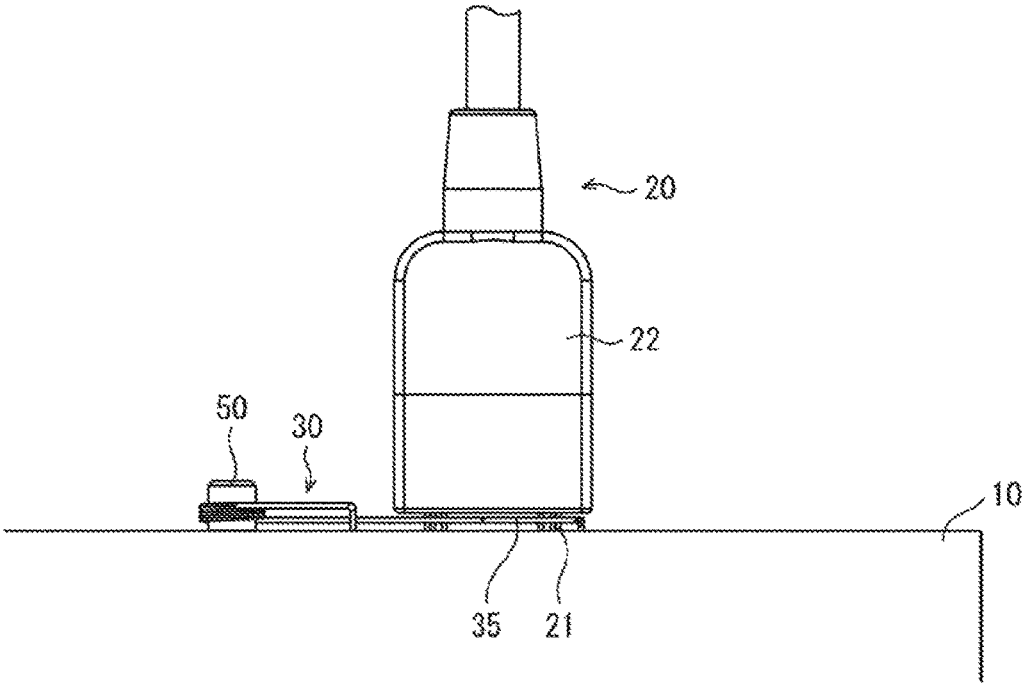
FIG. 4 is a side view illustrating a contact state of the torsion coil spring and a metal shell of when the cable connector is attached.

FIG. 4 is a view illustrating a state of when FIG. 1 is viewed in a direction of an arrow X. The straight part 35 of the torsion coil spring 30 enters a space between the holding part 22 of the metal shell 21 and the shield plate 10 and is abutted to a side surface of the metal shell 21. Note that the holding part 22 is usually made of an insulating material such as resin.

Figure 5:
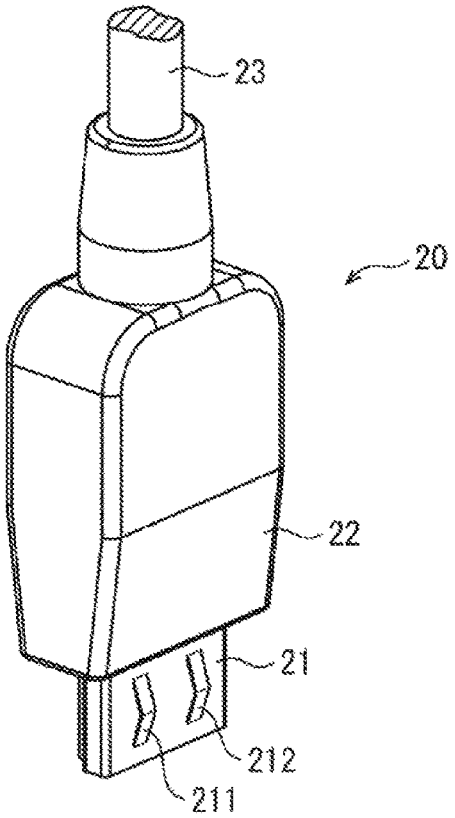
FIG. 5 is a perspective view of a metal shell and a holding part of the cable connector.

FIG. 5 is an external perspective view of the cable connector 20.

Figure 6:
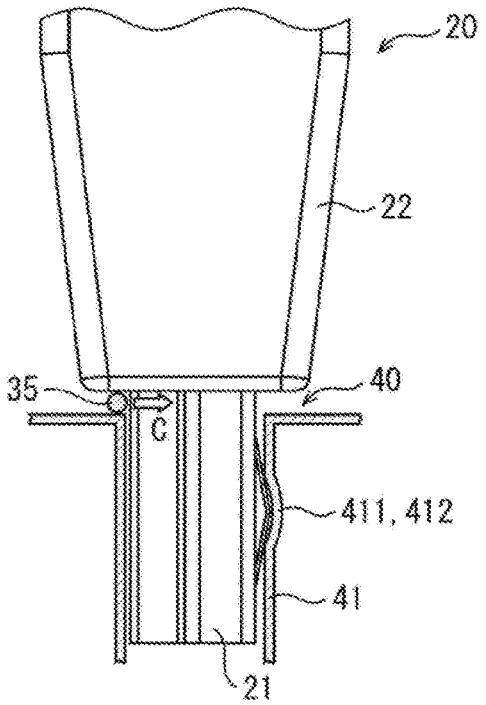
FIG. 6 is a view illustrating a biased direction of the metal shell by the torsion coil spring when the cable connector is connected to the interface connector.

As illustrated in the drawing, engagement protrusions 211 and 212 are formed on one side surface of the metal shell 21 of the cable connector 20 and are respectively engaged with engagement recesses 411 and 412 formed on an inner side surface of the inner shell 41 as illustrated in FIG. 6 (engagement recess 412 is not seen since being overlapped with engagement recess 411 in FIG. 6) when the metal shell 21 is inserted into the inner shell 41 of the interface connector 40.

Then, the straight part 35 of the torsion coil spring 30 biases a side surface of the metal shell 21, which surface is on an opposite side of the side on which the engagement protrusions 211 and 212 are formed, in a direction orthogonal to an insertion direction of the cable connector 20 toward a direction where there are the engagement recess 411 and 412 of the inner shell 41. Thus, an engagement state of the engagement protrusions 211 and 212 of the metal shell 21 and the engagement recesses 411 and 412 of the inner shell 41 becomes good and the cable connector 20 is less likely to come off.

Modification Example

In the above, the present invention has been described on the basis of an embodiment. However, it is obvious that the present invention is not limited to the above-described embodiment, and the following modification examples are conceivable.

(1) In the above embodiment, the coil part 31 of the torsion coil spring 30 is pivotally supported by the metallic support pin 50. However, a shaft part of a cord clamp member may be used instead of the support pin 50.

Figure 7:
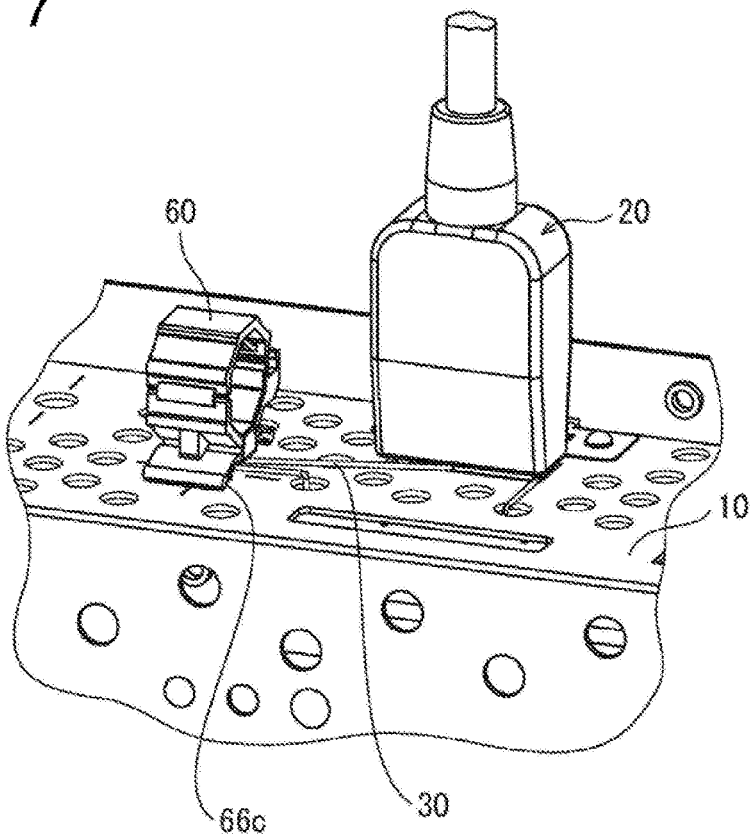
FIG. 7 is a view illustrating a state where a coil part of the torsion coil spring is pivotally supported by a cord clamp member.

FIG. 7 is a perspective view illustrating an example in which a coil part 31 of a torsion coil spring 30 is supported by a shaft of a cord clamp member 60.

Figure 8:
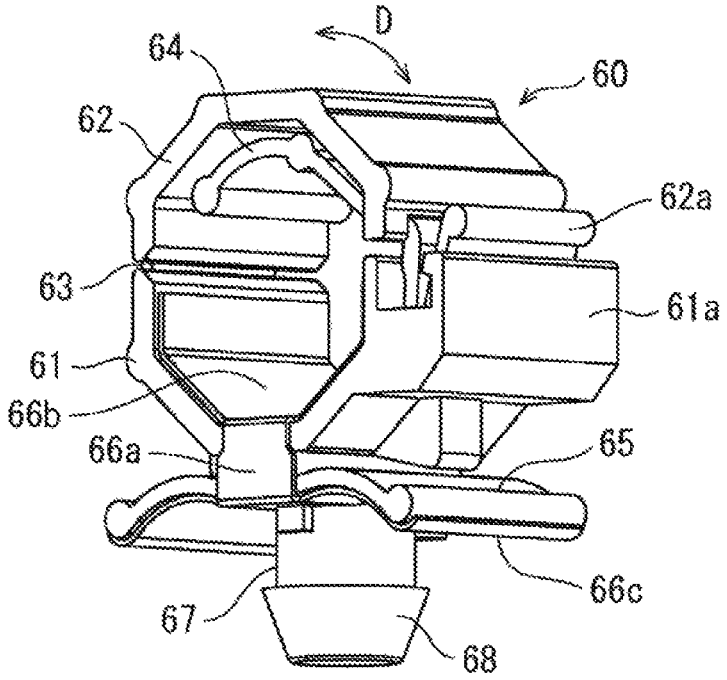
FIG. 8 is a perspective view of the cord clamp member.

The cord clamp member 60 is made of an elastic resin. As illustrated in FIG. 8, a lower clamp part 61 and an upper clamp part 62 can be opened/closed in a direction D via a hinge part 63. A cord pressing member 64 is formed in the upper clamp part 62.

In a state where a cord is sandwiched and fixed between the lower clamp part 61 and the cord pressing member 64, a protrusion of a knob part 62*a* formed at an end part of the upper clamp part 62 enters a recess part of a receiving part 61*a* formed at an end part of the lower clamp part 61 and is snapped.

A curved arcate wing part 65 is formed below the lower clamp part 61, and a shaft part 67 and a conical protrusion 68 are formed at a center part of the wing part 65.

Metallic plate springs 66*b* and 66*c* are respectively installed on an inner peripheral surface of the lower clamp part 61 and a lower surface of the wing part 65, the two being connected by a metal plate 66*a*. The plate springs 66*b* and 66*c* and the metal plate 66*a* are integrally formed by stamping and bending of one metal plate.

When the shaft part 67 is pushed into a through hole of a shield plate 10, the conical protrusion 68 is engaged with a back surface of the shield plate 10 and is snapped. Since the metal plate 66*c* of the wing part 65 contacts the shield plate 10 in this state, the metal plate 66*b* of the lower clamp part 61 is grounded and radiation noise due to a clamped cord is decreased.

In the present modification example, the coil part 31 of the torsion coil spring 30 is supported by the shaft part 67 of the cord clamp member 60. With a snap function of the shaft part 67 of the cord clamp member 60, the coil part 31 is pushed by the metal plate 66*c* on the lower surface of the wing part 65 and pressed against the shield plate 10 and an end part in an extending direction of the wing part 65 of the metal plate 66*c* contacts the shield plate 10 as illustrated in FIG. 7. Thus, a grounded state of the torsion coil spring 30 is remarkably improved compared to a case where the coil part 31 is simply supported by the support pins 50 as in the above embodiment.

(2) By appropriate selection of a wire diameter of a torsion coil spring 30 as a wire spring, when a cable connector 20 is inserted into and connected to an interface connector 40, a straight part 35 of the torsion coil spring 30 may be held between a holding part 22 of a cable connector 20 and a shield plate 10 while being in contact with a metal shell 21.

This makes it possible to further strengthen a state of electrical connection between the torsion coil spring 30 and the shield plate 10.

(3) In the above embodiment, the torsion coil spring 30 has been described as a conductive member in contact with the metal shell 21. However, this configuration is not necessarily the limitation. A conductive member having a thickness with which it is possible to enter a gap between a holding part 22 of a cable connector 20 and a shield plate 10 and to be abutted to a metal shell 21 may be biased by a different elastic member in a direction of the metal shell 21.

(4) In the above embodiment, as units to prevent the cable connector 20 from coming off, the engagement protrusions 211 and 212 are provided on a side of the metal shell 21 of the cable connector 20 and the engagement recesses 411 and 412 are provided on a side of the inner shell 41 of the interface connector 40 as illustrated in FIG. 5 and FIG. 6. However, it is possible to provide an engagement recess on a side of a metal shell 21 and an engagement protrusion on a side of an inner shell 41.

(5) An embodiment of the present invention can be applied to all electronic devices including a shield plate and an interface connector and can be also applied to a controller of an image forming apparatus, or an electronic device in a different apparatus.

Also, an embodiment of the present invention can also be regarded as a ground structure of a cable connector in an electronic device.

(6) Also, contents of the above embodiment and modification examples may be combined wherever possible.

An embodiment of the present invention is preferable as a grounding technology of a cable connector in an electronic device.

According to an embodiment of the present invention, with the above configuration, when a cable connector is inserted into and connected to an interface connector, a conductive member electrically connected to a shield plate is biased in such a manner as to come into contact with an exposed part that is on a side surface of the metal shell part and that is between the holding part and the interface connector. Thus, with a simple configuration, the metal shell of the cable connector can be grounded while being securely connected to the shield plate, an influence of external electromagnetic noise entering via the cable connector on the circuit board of the electronic device can be prevented, and generation of radiation noise can be decreased.

Although embodiments of the present invention have been described and illustrated in detail, it is clearly understood that the same is by way of illustration and example only and not limitation, the scope of the present invention should be interpreted by terms of the appended claims.

What is claimed is:

1. An electronic device comprising:

a grounded shield plate; and a female-type interface connector, wherein a conductive member electrically connected to the shield plate is included, and when a male-type cable connector including a metal shell part and a holding part to hold the metal shell part is inserted into and connected to the interface connector, the conductive member is biased in such a manner as to come into contact with an exposed part that is on a side surface of the metal shell part and is between the holding part and the shield plate.

2. The electronic device according to claim 1, wherein the conductive member is made of an elastic material and is in contact with the side surface of the metal shell part in a direction orthogonal to an insertion direction of the cable connector by using own elastic force.

3. The electronic device according to claim 1, wherein a second engagement part that is engaged with a first engagement part, which is formed on an inner surface of a metal shell part on a side of the interface connector, when inserted into the interface connector is included on one side surface of the metal shell part of the cable connector, and the conductive member is arranged in such a manner as to bias a side surface of the metal shell part of the cable connector which surface is opposite to the side surface on which the second engagement part is formed.

4. The electronic device according to claim 1, wherein in a state where the cable connector is not inserted, a part of the conductive member is arranged at a position overlapped with an opening part of the interface connector when viewed in an insertion direction of the interface connector.

5. The electronic device according to claim 4, wherein the conductive member is a wire spring, and in a state where the cable connector is not inserted, a part of the wire spring is arranged in such a manner as to include a part extending obliquely with respect to one side of the opening part of the interface connector when viewed in the insertion direction of the interface connector.

6. The electronic device according to claim 1, wherein the conductive member is a torsion coil spring, and a coil part of the torsion coil spring is supported by a shaft part of a cord clamp member attached to the shield plate.

7. The electronic device according to claim 6, wherein in the cord clamp member, a metal plate spring is arranged at a part facing the shield plate, the coil part is supported by the shaft part in a state of being held between the plate spring and the shield plate, and a part of the plate spring is in contact with the shield plate.

8. A ground structure of a male-type cable connector connected to a female-type interface connector of an electronic device including a grounded shield plate and the female-type interface connector, wherein the cable connector includes a metal shell part and a holding part to hold the metal shell part, the electronic device includes a conductive member electrically connected to the shield plate, and the conductive member is biased in such a manner as to come into contact with an exposed part that is on a side surface of the metal shell part of the cable connector connected to the interface connector and that is between the holding part and the shield plate.

* * * * *